US008520033B2

(12) United States Patent
Cheng

(10) Patent No.: US 8,520,033 B2
(45) Date of Patent: Aug. 27, 2013

(54) SOURCE DRIVER OF IMAGE DISPLAY SYSTEMS AND METHODS FOR DRIVING PIXEL ARRAY

(75) Inventor: Jen-Wen Cheng, Tainan County (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 445 days.

(21) Appl. No.: 12/764,264

(22) Filed: Apr. 21, 2010

(65) Prior Publication Data

US 2011/0261041 A1 Oct. 27, 2011

(51) Int. Cl.
*G09G 5/10* (2006.01)

(52) U.S. Cl.
USPC ..... 345/690; 345/89

(58) Field of Classification Search
USPC ..... 345/89, 690
See application file for complete search history.

(56) References Cited

U.S. PATENT DOCUMENTS 7,764,212 B2 * 7/2010 Lee et al. ..... 341/145
2003/0052854 A1 * 3/2003 Juang ..... 345/96
2008/0122672 A1 * 5/2008 Chang et al. ..... 341/145
2008/0211835 A1 * 9/2008 Enjou ..... 345/690
2011/0102471 A1 * 5/2011 Hsu et al. ..... 345/690

* cited by examiner

*Primary Examiner* — Kwang-Su Yang

(74) *Attorney, Agent, or Firm* — McClure, Qualey & Rodack, LLP

(57) ABSTRACT

An image display system and a pixel array driving method thereof are disclosed. The image display system has a source driver having a first and a second digital-to-analog converter and a first and a second switching circuit. The first digital-to-analog converter converts an N-bit digital code to a first analog signal, where N is a positive integer. The second digital-to-analog converter converts a K-bit digital code to a second analog signal, where K is a positive integer and is smaller than N. The first switching circuit controls coupling between a first display data, a second display data and the first and second digital-to-analog converters, and, the second switching circuit controls connections between the first and second analog signals and a first and a second operational amplifier. The first and second operational amplifiers are coupled to a first and a second data line of a pixel array, respectively.

14 Claims, 12 Drawing Sheets

SOURCE DRIVER OF IMAGE DISPLAY SYSTEMS AND METHODS FOR DRIVING PIXEL ARRAY

BACKGROUND OF THE INVENTION

1. Field of the Invention

The present invention relates to image display systems, and in particular relates to source drivers thereof.

2. Description of the Related Art

In an image display system, more than one source driver may be fixed on a glass of a pixel array to transmit data signals to the data lines driving the pixel array.

In efforts to decrease costs and reduce size, a smaller-sized source driver is desired.

BRIEF SUMMARY OF THE INVENTION

An image display system with small-sized source drivers is disclosed.

According to an exemplary embodiment of the invention, the source driver comprises a first digital-to-analog converter, a second digital-to-analog converter, a first switching circuit and a second switching circuit. The first digital-to-analog converter converts an N-bit digital code to a first analog signal, where N is a positive integer. The second digital-to-analog converter converts a K-bit digital code to a second analog signal, where K is a positive integer and is smaller than N. The first switching circuit controls coupling between a first display data, a second display data and the first and second digital-to-analog converters, and, the second switching circuit controls connections between the first and second analog signals and a first and a second operational amplifier. The first operational amplifier is coupled to a first data line of a pixel array. The second operational amplifier is coupled to a second data line of the pixel array.

In the aforementioned embodiment, the first and second display data may be both N bits. Control methods of the first and second switching circuits are also disclosed. According to an exemplary embodiment of the invention, the control scheme includes at least two modes. During a first time period of a scanning of a first row of the pixel array, the first switching circuit is controlled to couple all bits of the first display data to the first digital-to-analog converter and to couple K most significant bits of the second display data to the second digital-to-analog converter, and the second switching circuit is controlled to connect the first analog signal to the first operational amplifier and to connect the second analog signal to the second operational amplifier. During a second time period of the scanning of the first row of the pixel array and after the first time period, the first switching circuit is controlled to couple all bits of the second display data to the first digital-to-analog converter and the second switching circuit is controlled to connect the first analog signal to the second operational amplifier.

During the first time period, the pixel at the first row and connected to the first data line is directly charged to its target voltage level while the pixel at the first row and connected to the second data line is just pre-charged to its intermediate voltage level. During the second time period, the pixel at the first row and connected to the first data line is not required to be charged and the source driver is devoted to charge the pixel at the first row and connected to the second data line from the intermediate voltage level to its target voltage level.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
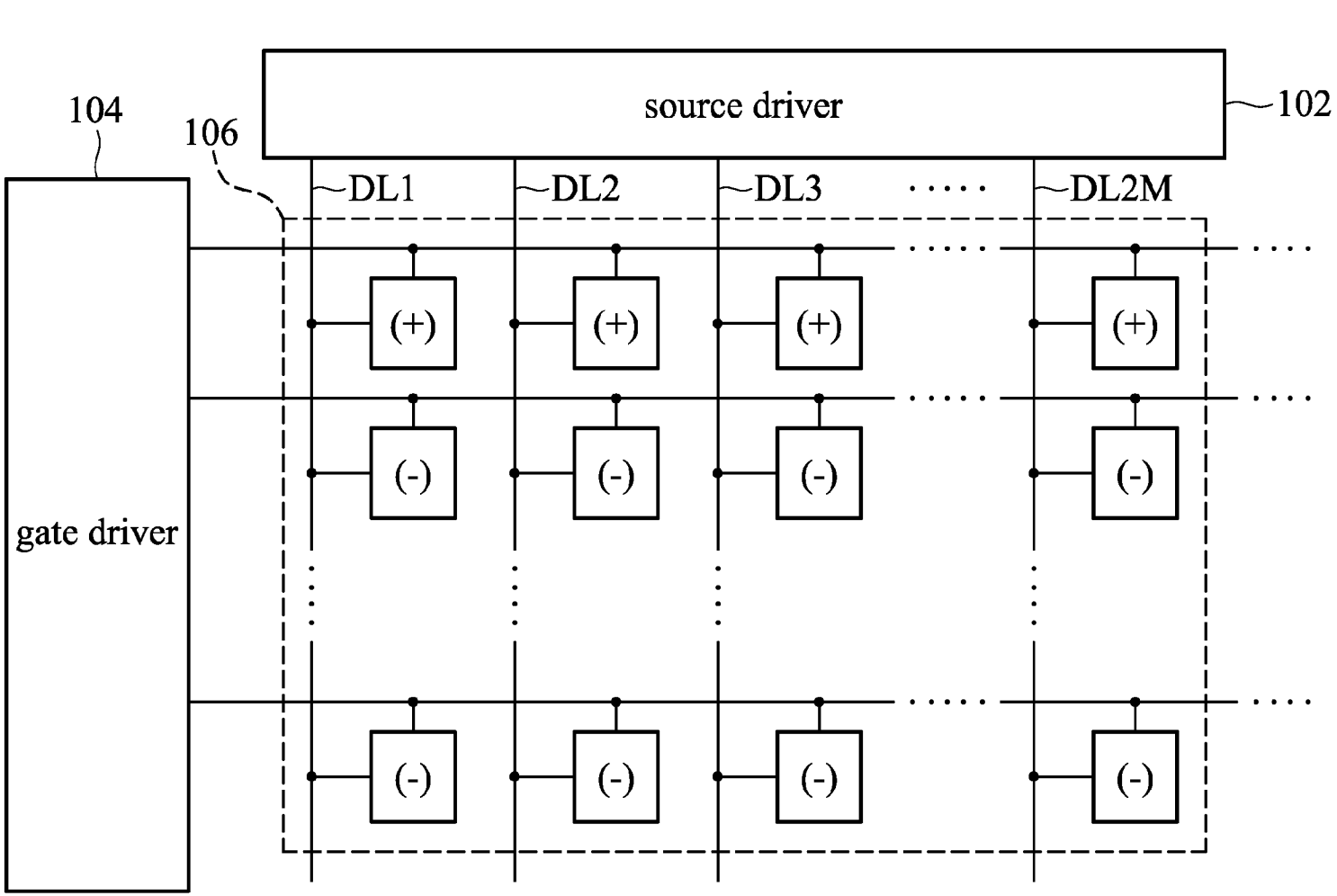
FIG. 1 shows an image display system.

FIG. 1 shows an image display system 100 comprises a source driver 102 of the invention, a gate driver 104 and a pixel array 106. The gate driver 104 controls the scanning of the pixel array 106. The source driver 102 transmits data signals Data1, Data2, Data3 . . . Data2M to the pixel array 106 via data lines DL1, DL2, DL3 . . . DL2M, respectively. In this embodiment, the source driver 102 controls the pixel array 106 to display images according to a row inversion technique: pixels on the same row are controlled by voltages of the same polarity while pixels on adjacent rows are controlled by voltages of opposite polarities.

Figure 2:
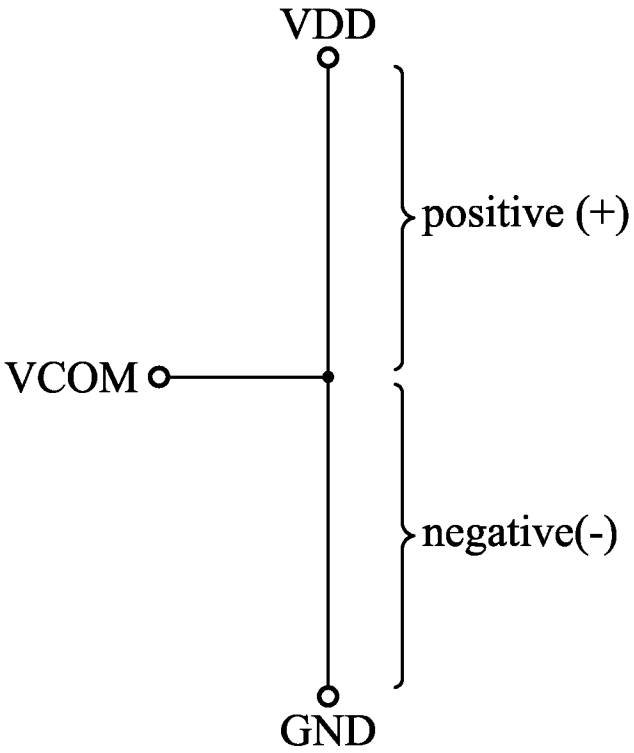
FIG. 2 shows the definition of positive and negative polarities.

FIG. 2 shows the definition of the above said polarities. As shown, the data signals (Data1 . . . Data2M) transmitted by the data lines DL1 . . . DL2M may be allowed within a voltage range GND~VDD. A common voltage is arranged between the ground GND and the source voltage VDD. A voltage between the common voltage Vcom and the source voltage VDD is considered as a positive polarity (labeled by +) voltage. A voltage between the ground GND and the common voltage Vcom is considered as a negative polarity (labeled by −) voltage.

Figure 3:
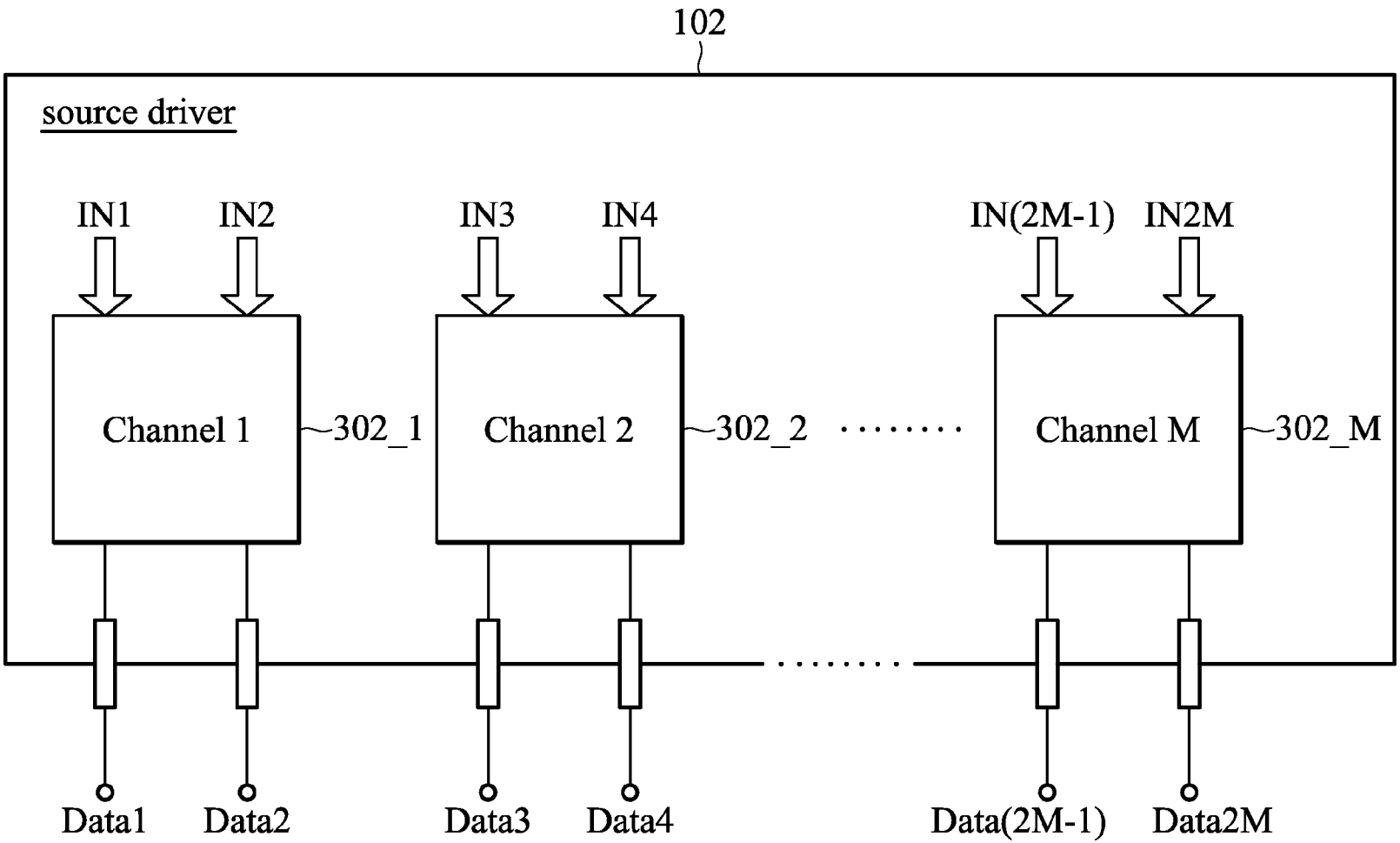
FIG. 3 shows an exemplary embodiment of the source driver of the invention.

FIG. 3 shows an exemplary embodiment of the source driver 102 of the invention. There are several channels 302_1, 302_2 . . . 302_M in the source driver 102. Each channel receives two display data (digital) and outputs two data signals (analog) for two data lines of the pixel array 106. For example, two display data IN1 and IN2 are sent to a channel 302_1 to be converted to two data signals Data1 and Data2 to be transmitted by data lines DL1 and DL2. Also, two display data IN3 and IN4 are sent to a channel 302_2 to be converted to two data signals Data3 and Data4 to be transmitted by data lines DL3 and DL4. As to the channel 302_M at the right end of the source driver 102, two display data IN(2M-1) and IN2M are converted to two data signals Data(2M-1) and Data2M to be transmitted by data lines DL(2M-1) and DL2M.

Figure 4:
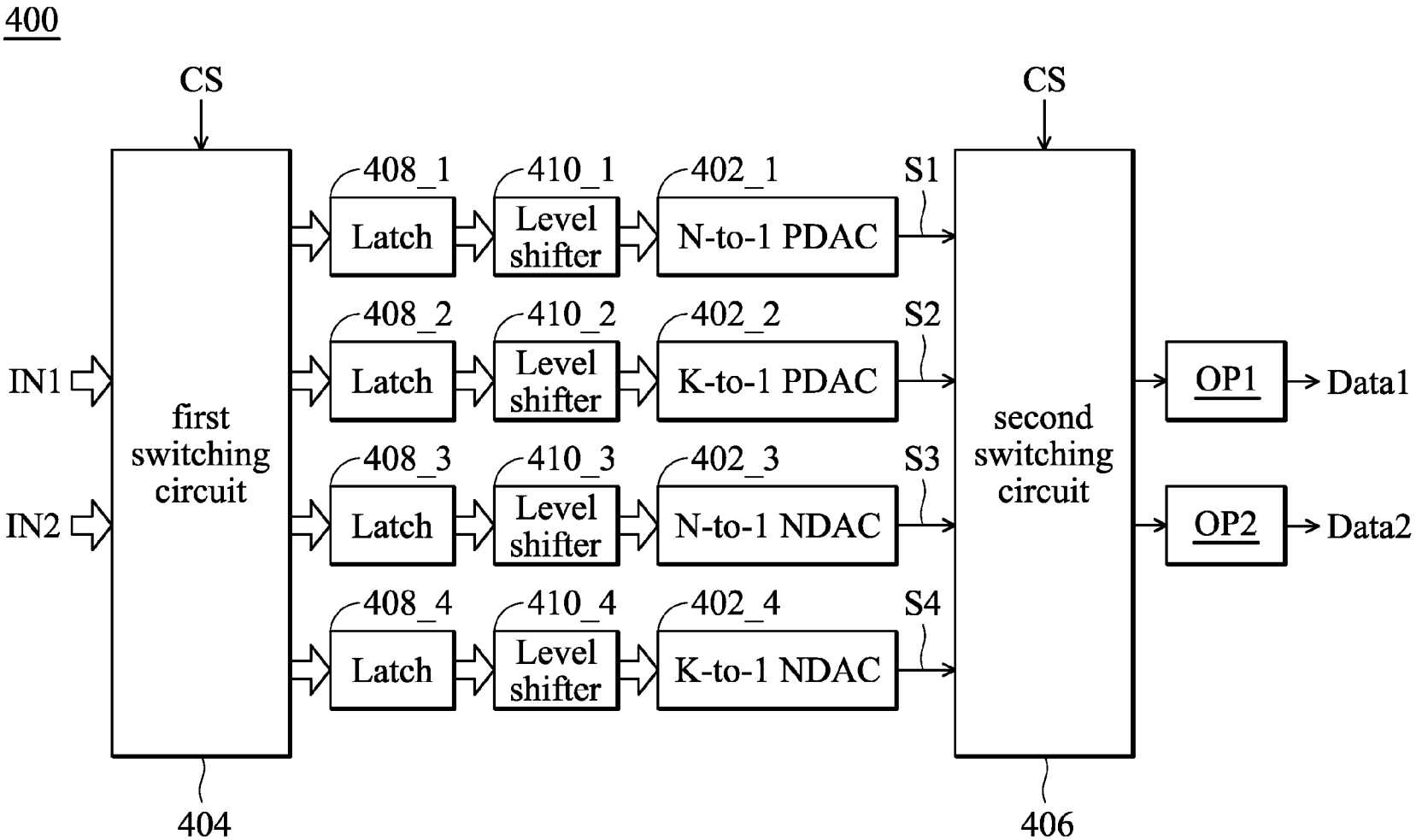
FIG. 4 depicts an exemplary embodiment of a channel of the source driver of the invention.

FIG. 4 depicts an exemplary embodiment of a channel of the invention. Channel 400 comprises four digital-to-analog converters (DACs) 402_1, 402_2, 402_3 and 402_4, a first switching circuit 404 and a second switching circuit 406, and may further comprise a first operational amplifier OP1 and a second operational amplifier OP2, latches 408_1 . . . 408_4 and level shifters 410_1 . . . 410_4. The operational amplifiers OP1 and OP2 may be rail-to-rail operational amplifiers and, in other embodiments, the first and second operational amplifiers OP1 and OP2 may be built outside the source driver 102. As for the latches 408_1 . . . 408_4 and the level shifters 410_1 . . . 410_4, they are arranged subsequent to the first switching device 404 and prior to the DACs 402_1 . . . 402_4, and are optional devices.

The digital-to-analog converter 402_1 converts an N-bit digital code to an analog signal S1, where N is a positive integer. The digital-to-analog converter 402_2 converts a K-bit digital code to an analog signal S2, where K is a positive integer and is smaller than N. The digital-to-analog converter 402_3, having the same resolution with the digital-to-analog converter 402_1, converts an N-bit code to an analog signal S3. The digital-to-analog converter 402_4, having the same resolution with the digital-to-analog converter 402_2, converts a K-bit code to an analog signal S4. The digital-to-analog converters 402_1 and 402_2 are positive polarity converters, and the generated analog signals S1 and S2 may be within a first voltage range between the common voltage (Vcom of FIG. 2) and the source voltage (VDD of FIG. 2). The digital-to-analog converters 402_3 and 402_4 are negative polarity converters, and the generated analog signals S3 and S4 may be within a second voltage range between the ground (GND of FIG. 2) and the common voltage (Vcom of FIG. 2). Note that the digital-to-analog converters 402_2 and 402_4 are specially designed to have a lower resolution than the digital-to-analog converters 402_1 and 402_3 (since K<N). Thus, the size of the source driver 102 is smaller in comparison with conventional source drivers in which all DACs are of the same resolution. In some embodiments, N may be 64 while K is 4.

In the following discussion, the latches 408_1 . . . 408_4 and the level shifters 410_1 . . . 410_4 are omitted for simplicity. The first switching circuit 404 determines how to couple a first display data IN1 and a second display data IN2 to the inputs of the digital-to-analog converters 402_1, 402_2, 402_3 and 402_4. The second switching circuit 406 controls connections between the outputs of the digital-to-analog converters 402_1, 402_2, 402_3 and 402_4 and the inputs of the first and second operational amplifiers OP1 and OP2. The first and second switching circuits 404 and 406 are controlled by at least one control signal CS. FIGS. 5A~5D show different connections provided by the first and second switching circuits 404 and 406.

Figure 5A:
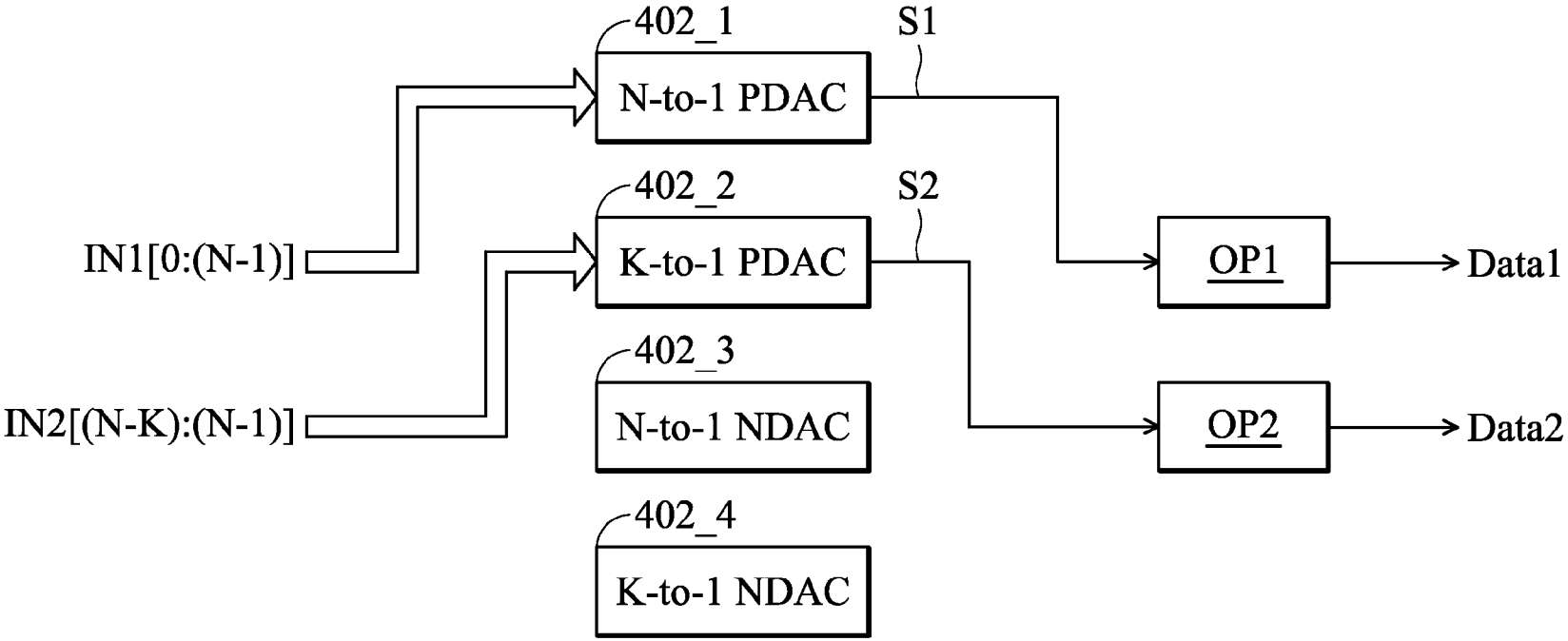
FIGS. 5A~5D show a first, a second, a third and a fourth connecting mode of channel 400 of FIG. 4.

FIG. 5A shows a first connecting mode provided by the first and second switching circuits 404 and 406. As shown, the first switching circuit 404 couples all bits of the first display data IN1[0:(N-1)] to the digital-to-analog converter $402_{_1}$ and couples K most significant bits (MSBs) of the second display data IN2((N-K):(N-1)) to the digital-to-analog converter 402_2. The second switching circuit 406 connects the analog signal S1 to the first operational amplifier OP1 and connects the analog signal S2 to the second operational amplifier OP2. A first data signal Data1 is generated at the output terminal of the first operational amplifier OP1 and is transmitted to a first data line of the pixel array (DL1 of FIG. 1). A second data signal Data2 is generated at the output terminal of the second operational amplifier OP2 and is transmitted to a second data line of the pixel array (DL2 of FIG. 1). Positive polarity voltages are provided on the first and second data lines DL1 and DL2. The digital-to-analog converters 402_3 and 402_4 are inactive in the first connecting mode.

Figure 5B:
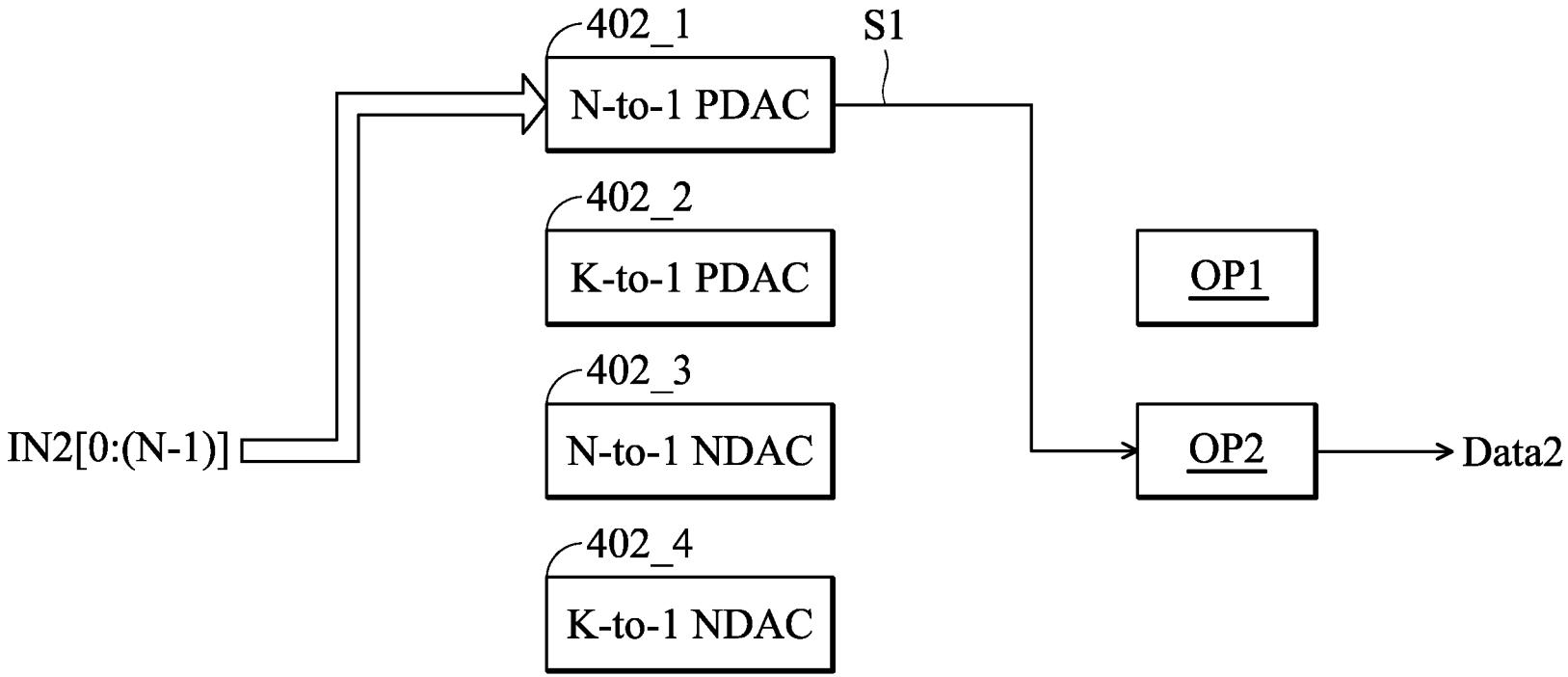

FIG. 5B shows a second connecting mode provided by the first and second switching circuits 404 and 406. As shown, the first switching circuit 404 couples all bits of the second display data IN2[0:(N-1)] to the digital-to-analog converter 402_1. The second switching circuit 406 sends the analog signal S1 to the second operational amplifier OP2 to generate the second data signal Data2 and so that a positive polarity voltage is provided on the second data lines DL2 of FIG. 1. The digital-to-analog converters 402_2, 402_3 and 402_4 and the first operational amplifier OP1 are inactive in the second connecting mode.

Figure 5C:
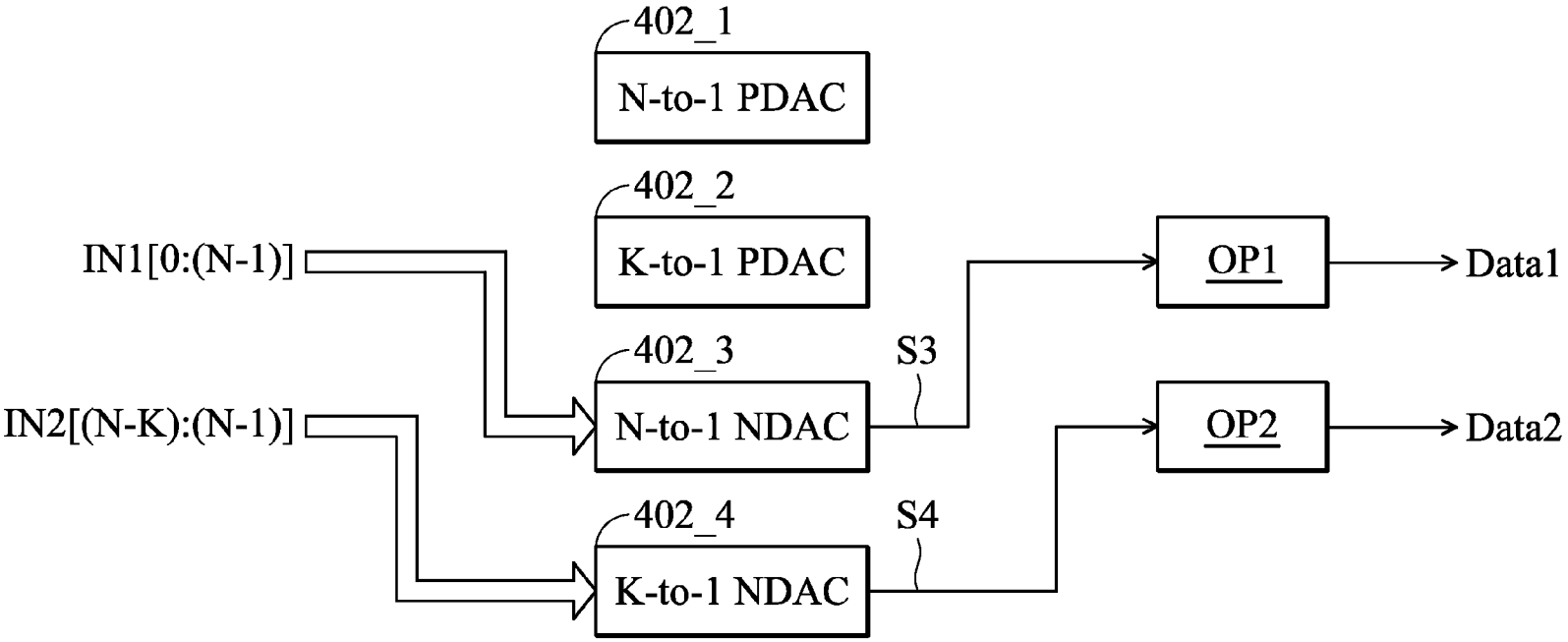

FIG. 5C shows a third connecting mode provided by the first and second switching circuits 404 and 406. As shown, the first switching circuit 404 couples all bits of the first display data IN1[0:(N-1)] to the digital-to-analog converter 402_3 and couples K most significant bits (MSBs) of the second display data IN2((N-K):(N-1)) to the digital-to-analog converter 402_4. The second switching circuit 406 connects the analog signal S3 to the first operational amplifier OP1 to generate the first data signal Data1 and connects the analog signal S4 to the second operational amplifier OP2 to generate the second data signal Data2. Negative polarity voltages are provided on the first and second data lines DL1 and DL2 (of FIG. 1) which transmits the data signals Data1 and Data2, respectively. The digital-to-analog converters 402_1 and 402_2 are inactive in the third connecting mode.

Figure 5D:
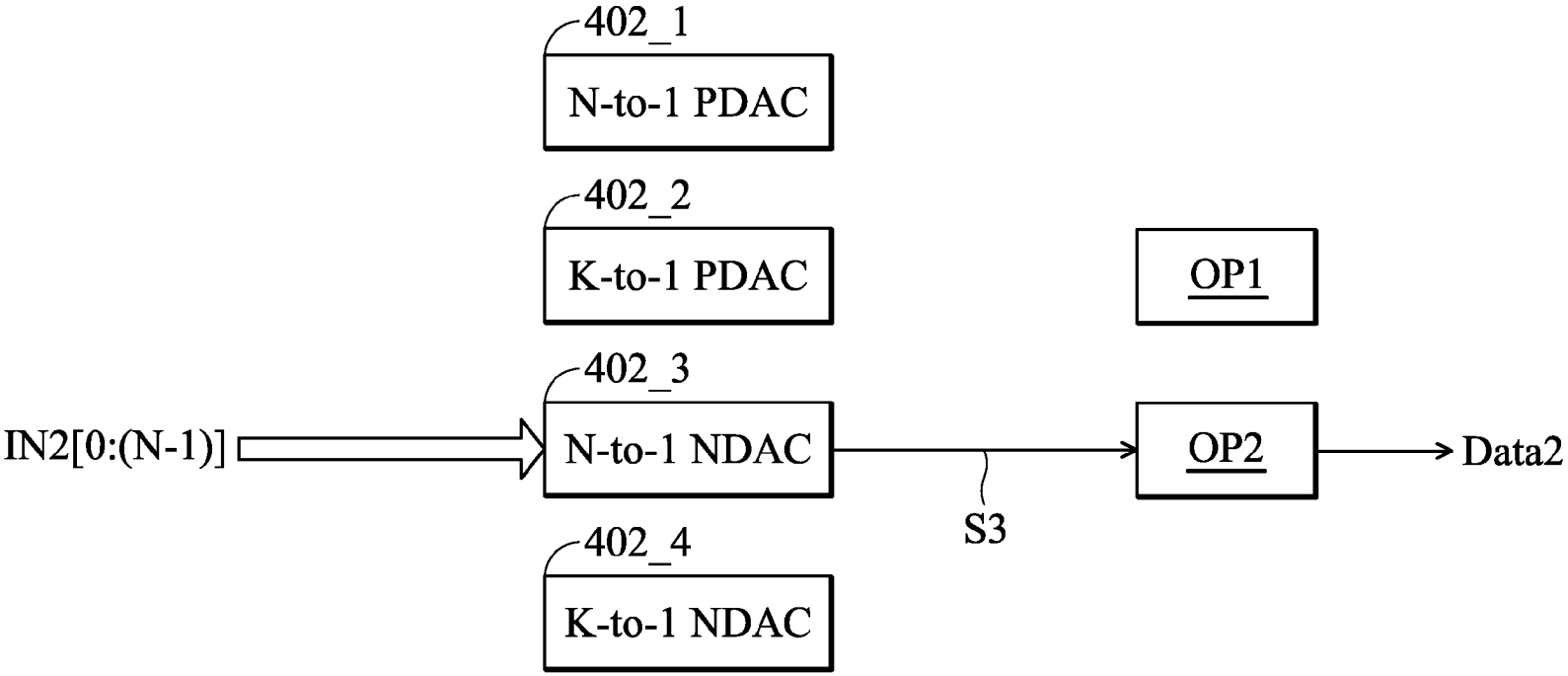

FIG. 5D shows a fourth connecting mode provided by the first and second switching circuits 404 and 406. As shown, the first switching circuit 404 couples all bits of the second display data IN2[0:(N-1)] to the digital-to-analog converter 402_3. The second switching circuit 406 sends the analog signal S3 to the second operational amplifier OP2 to generate the second data signal Data2 and so that a negative polarity voltage is provided on the second data line DL2 of FIG. 1. The digital-to-analog converters 402_1, 402_2 and 402_4 and the first operational amplifier OP1 are inactive in the second connecting mode.

Figure 6A:
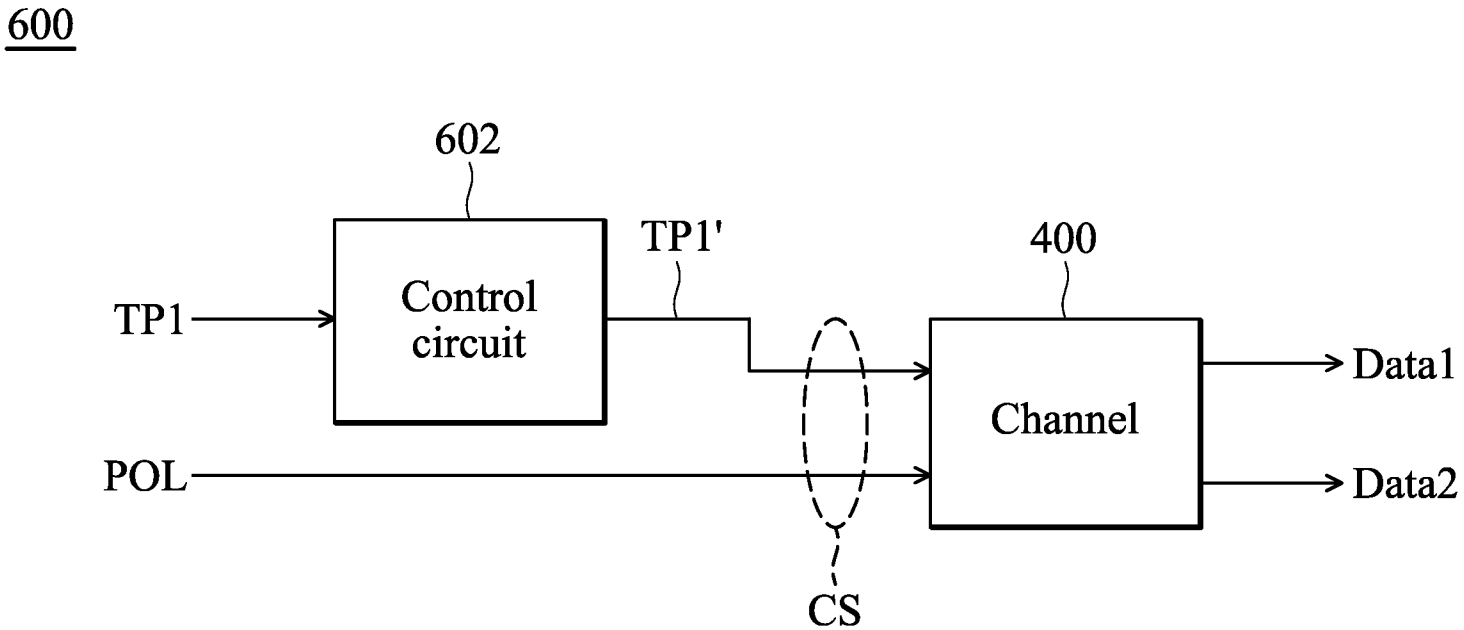
FIG. 6A illustrates the source of the at least one control signal CS which controls the first and second switching devices 404 and 406 of the channel 400.

FIG. 6A illustrates the source of the at least one control signal CS which controls the first and second switching devices 404 and 406 of the channel 400. As shown, an image display system 600 comprises the channel 400 and a control circuit 602. The control circuit 602 generates a signal TP1' according to a horizontal sync signal TP1, to form the at least one control signal CS with a polarity bit POL. The horizontal sync signal TP1 and the polarity bit POL are provided by a timing controller (not shown, but known by those skilled in the art). The horizontal sync signal TP1 demarcates the display data for each row of the pixel array. The polarity bit POL shows the polarity of the scanned row. In some embodiments, the control circuit 602 may be built in the timing controller. Alternatively, in some embodiments, the control circuit 602 may be built inside the source driver (containing the channel 400) rather than being added to the timing controller. In other embodiments, the control circuit 602 may be a circuit outside of the timing controller and the source driver.

Figure 6B:
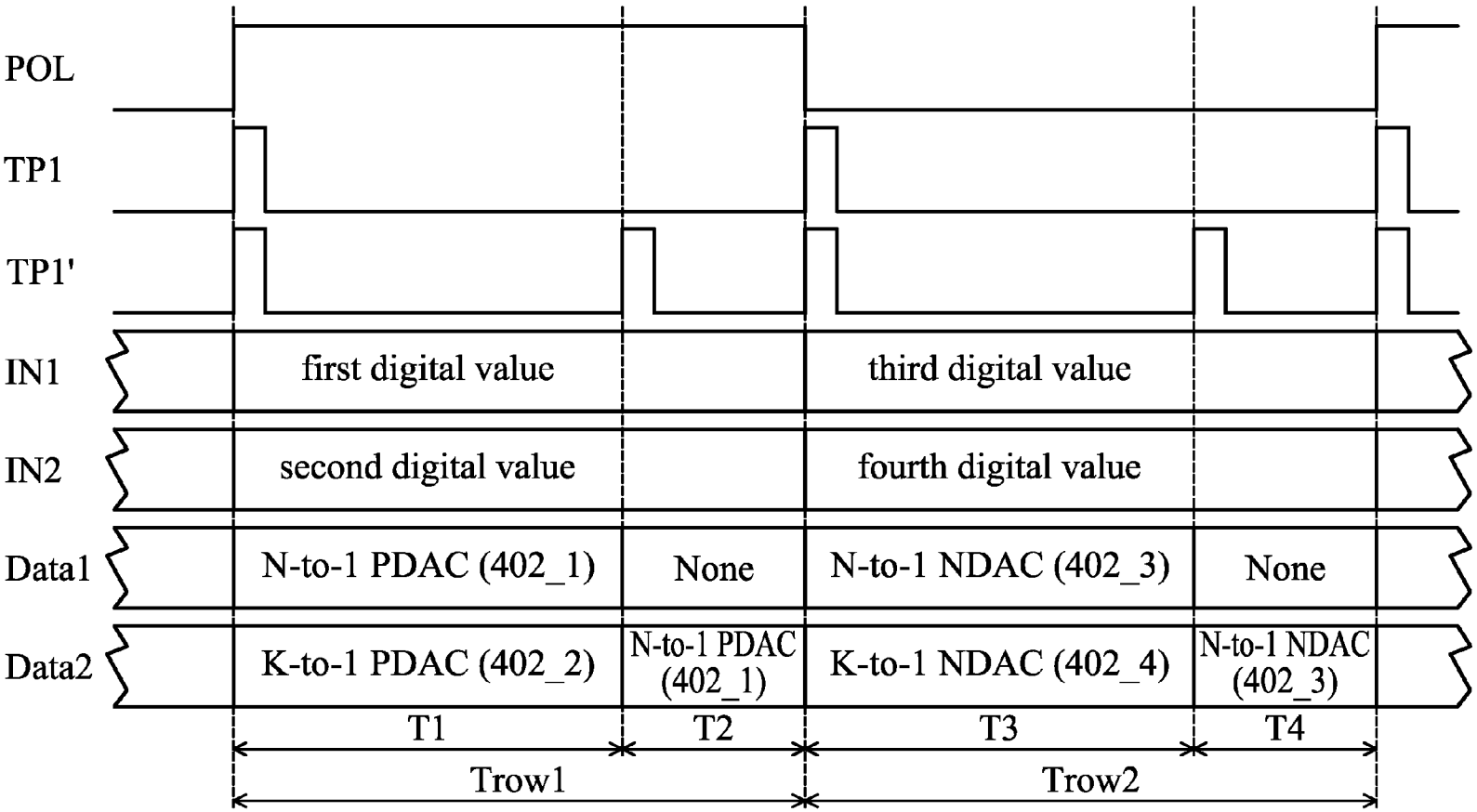
FIG. 6B uses waveforms to show the control scheme of the first and second switching circuits 404 and 406 of the channel 400 while the control signals taught in FIG. 6A is applied.

According to the control signals POL and TP1' taught in FIG. 6A, FIG. 6B uses waveforms to show the control scheme of the first and second switching circuits 404 and 406 of the channel 400. First, discussing the functions of the horizontal sync signal TP1 and the polarity bit POL when a row inversion technique is applied. According to the first pulse of the horizontal sync signal TP1, a time period Trow1 is provided to scan a first row of the pixel array, and the state of the polarity bit POL shows that positive polarity voltages have to be forced on the first row of pixels for positive polarity driving. At the meanwhile, IN1 contains a first digital value to be displayed by a first pixel (at the first row and coupled to the data line DL1 of FIG. 1); and 1N2 contains a second digital value to be displayed by a second pixel (at the first row and coupled to the data line DL2 of FIG. 1). According to the second pulse of the horizontal sync signal TP1, a time period Trow2 is provided to scan a second row of the pixel array, and the state of the polarity bit POL shows that negative polarity voltages have to be forced on the second row of pixels for negative polarity driving. At the meanwhile, IN1 contains a third digital value to be displayed by a third pixel (at the second row and coupled to the data line DL1 of FIG. 1), and IN2 contains a fourth digital value to be displayed by a fourth pixel (at the second row and coupled to the data line DL2 of FIG. 1). The control signals, including the polarity bit POL and the signal TP1' taught in FIG. 6A, are applied in controlling the first and second switching circuits 404 and 406 of the channel 400 and, accordingly, said first, second, third and fourth connecting modes (shown in FIGS. 5A . . . 5D) are generated during four time periods T1 . . . T4 (shown in FIG. 6B), respectively. Referring to the annotations on the data signals Data1 and Data2 shown in FIG. 6B, it shows that: during the first time period T1, the content of Data1 comes from the N-to-1 PDAC 402_1 and the content of Data2 comes from the K-to-1 PDAC 402_2 and so that Data1 is charged to the target voltage of the first digital value (contained in the IN1) at a heat while Data2 is just pre-charged to an intermediate voltage level of the second digital value (contained in IN2); during the second time period T2, no modification is performed on Data1, and, at the meanwhile, the content of Data2 comes from the N-to-1 PDAC 402_1 to make up a deficiency in displaying the second digital value; during the third time period T3, the content of Data1 comes from the N-to-1 NDAC 402_3 and the content of Data2 comes from the K-to-1 NDAC 402_4 and so that Data1 is charged to the target voltage of the third digital value at a heat while Data2 is just pre-charged to an intermediate voltage level of the fourth digital value; during the fourth time period T4, no modification is performed on Data1, and, at the meanwhile, the content of data Data2 comes from the N-to-1 NDAC 402_3 to make up a deficiency in displaying the fourth digital value.

Figure 7A:
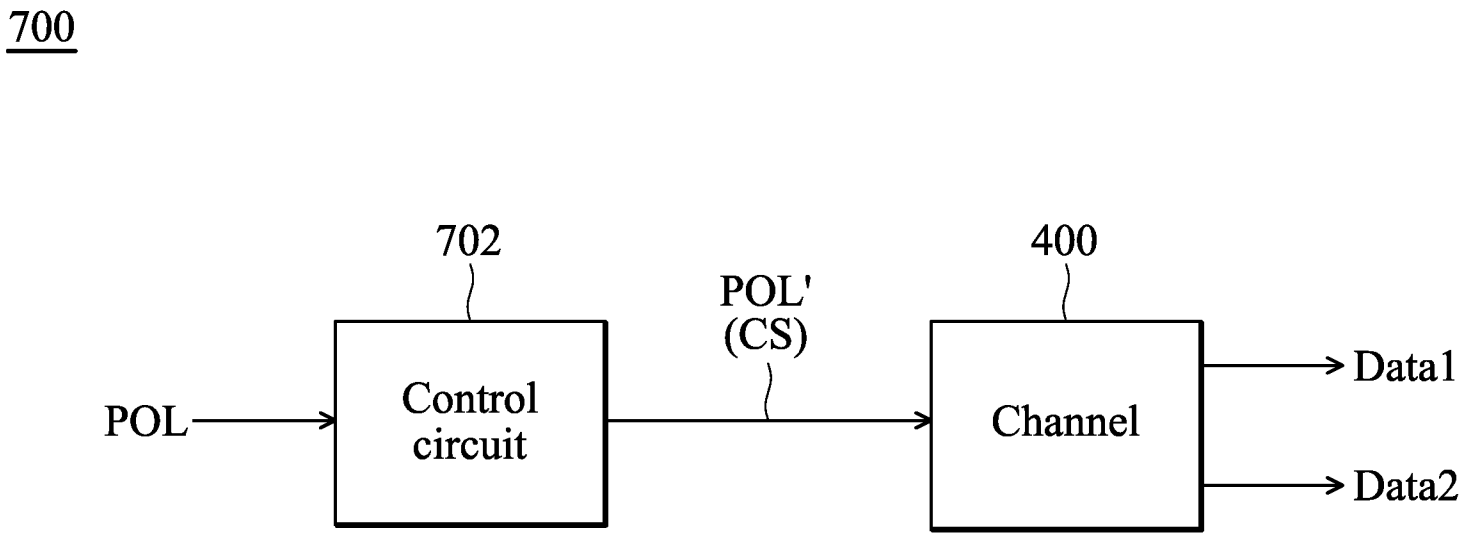
FIG. 7A illustrates another source of the at least one control signal CS which controls the first and second switching devices 404 and 406 of the channel 400.

In FIG. 7A, another source of the at least one control signal CS is disclosed. As shown, an image display system 700 comprises the channel 400 and a control circuit 702. The control circuit 702 generates a signal POL' according to the polarity bit POL, to form the at least one control signal CS controlling the first and second switching circuits 404 and 406 of the channel 400. In some embodiments, the control circuit 702 may be built in the timing controller providing the horizontal sync signal TP1 and the polarity bit POL. Alternatively, in some embodiments, the control circuit 702 may be built inside the source driver (containing the channel 400) rather than being added to the timing controller. In other embodiments, the control circuit 702 may be a circuit outside of the timing controller and the source driver. Note that when the control circuit 702 is not built inside the source driver, the source driver may require an additional pin for receiving the signal POL'.

Figure 7B:
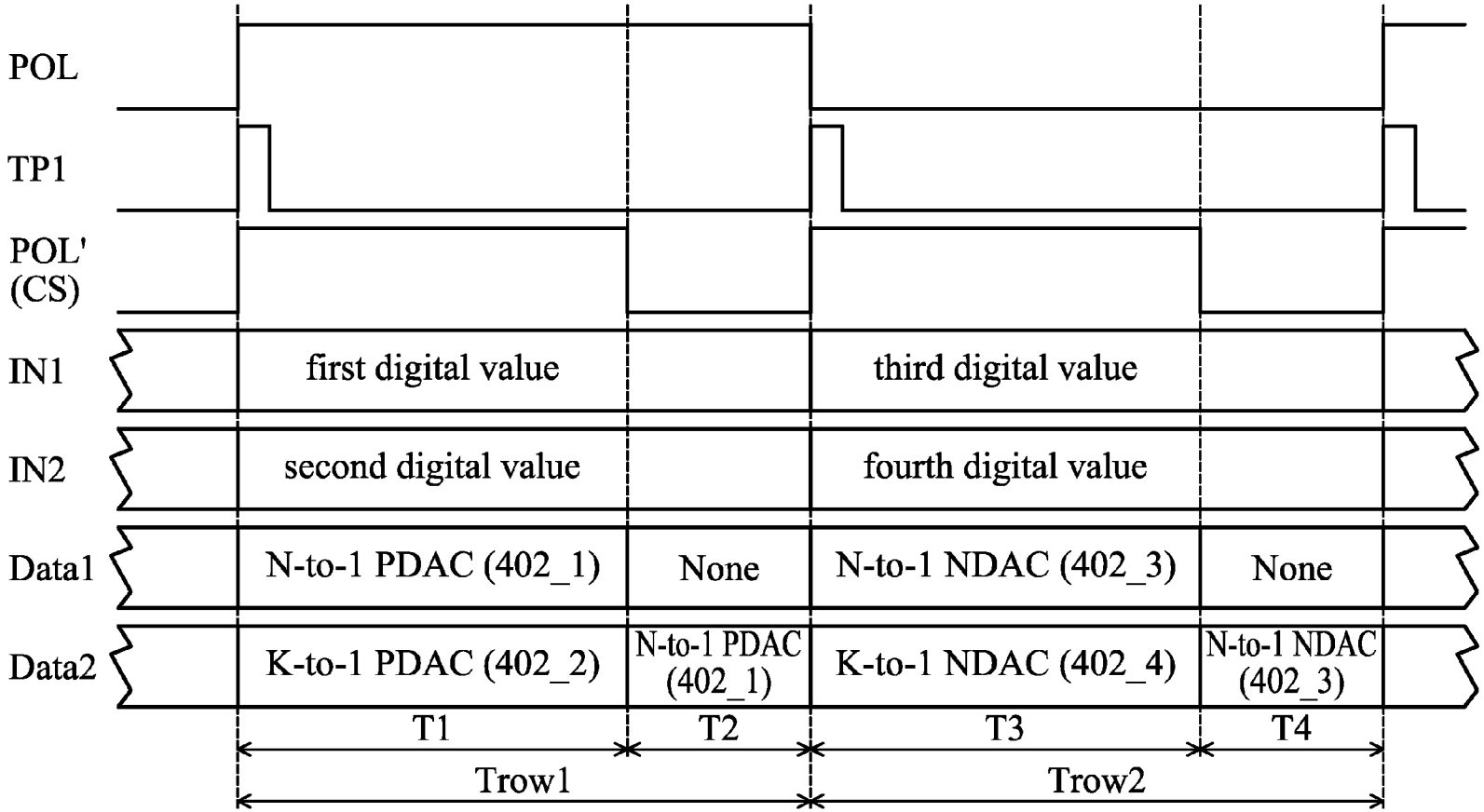
FIG. 7B uses waveforms to show the control scheme of the first and second switching circuits 404 and 406 of the channel 400 while the control signals taught in FIG. 7A is applied.

According to the control signal POL' taught in FIG. 7A, FIG. 7B uses waveforms to show the control scheme of the first and second switching circuits 404 and 406 of the channel 400. As shown, when the first and second switching circuits 404 and 406 of the channel 400 are controlled by the control signal POL', said first, second, third and fourth connecting modes (shown in FIGS. 5A . . . 5D) are generated during four time periods T1 . . . T4 (shown in FIG. 7B), respectively, to realize said row inversion technique.

In conclusion, the introduced pre-charging procedures (provided by the K-to-1 PDAC 402_2 and the K-to-1 NDAC 402_4) allow less high resolution DACs in each channel. For example, in conventional row inversion techniques, when a smooth display is called, a channel servicing two data lines generally requires at least four high resolution DACs. However, in the channel 400, a smooth display can be achieved as well, and only two high resolution DACs, including the N-to-1 PDAC 402_1 and the N-to-1 NDAC 402_3, are required while the rest two DACs are realized by two low resolution DACs (including the K-to-1 PDAC 402_2 and the K-to-1 NDAC 402_4). The circuit size and cost of the source drivers can be dramatically decreased.

Furthermore, the connections formed by the first and second switching circuits may be accomplished by software rather than electronic circuits. The methods controlling the coupling between the display data, the digital-to-analog converters and the operational amplifiers are also within the scope of the invention.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An image display system comprising a source driver, wherein the source driver comprises:

a first digital-to-analog converter, converting an N-bit digital code to a first analog signal, where N is a positive integer;

a second digital-to-analog converter, converting a K-bit digital code to a second analog signal, where K is a positive integer and is smaller than N; and a first switching circuit, controlling coupling between a first display data and a second display data and the first and second digital-to-analog converters, wherein the first and second display data are both N bits; and a second switching circuit, controlling connections between the first and second analog signals and a first operational amplifier and a second operational amplifier, wherein:

the first operational amplifier is coupled to a first data line of a pixel array, and the second operational amplifier is coupled to a second data line of the pixel array;

during a first time period of scanning of a first row of the pixel array, the first switching circuit couples the N bits of the first display data to the first digital-to-analog converter and couples the K most significant bits of the second display data to the second digital-to-analog converter, and the second switching circuit connects the first analog signal to the first operational amplifier and connects the second analog signal to the second operational amplifier; and during a second time period of the scanning of the first row of the pixel array and after the first time period, the first switching circuit couples the N bits of the second display data to the first digital-to-analog converter and the second switching circuit connects the first analog signal to the second operational amplifier.

2. The image display system as claimed in claim 1, further comprising:

a third digital-to-analog converter, converting an N-bit digital code to a third analog signal; and a fourth digital-to-analog converter, converting a K-bit digital code to a fourth analog signal, wherein:

the first and second digital-to-analog converters limit the first and second analog signals to within a first voltage range for positive polarity display;

the third and fourth digital-to-analog converters limit the third and fourth analog signals to within a second voltage range for negative polarity display;

the first switching circuit further controls coupling between the first and second display data and the third and fourth digital-to-analog converters; and the second switching circuit further controls connections between the third and fourth analog signals and the first and second operational amplifiers.

3. The image display system as claimed in claim 2, wherein:

during a third time period of scanning of a second row of the pixel array, the first switching circuit couples the N bits of the first display data to the third digital-to-analog converter and couples the K most significant bits of the second display data to the fourth digital-to-analog converter, and the second switching circuit connects the third analog signal to the first operational amplifier and connects the fourth analog signal to the second operational amplifier; and during a fourth time period of the scanning of the second row of the pixel array and after the third time period, the first switching circuit couples the N bits of the second display data to the third digital-to-analog converter and the second switching circuit connects the third analog signal to the second operational amplifier.

4. The image display system as claimed in claim 3, further comprising a timing controller providing a horizontal sync signal, a polarity bit and a modified horizontal sync signal, wherein the timing controller generates the modified horizontal sync signal based on the horizontal sync signal, and the modified horizontal sync signal and the polarity bit are applied in controlling the first and second switching circuits.

5. The image display system as claimed in claim 3, further comprising a timing controller providing a polarity bit and a modified polarity bit, wherein the timing controller generates the modified polarity bit based on the polarity bit, and the modified polarity bit is applied in controlling the first and second switching circuits.

6. The image display system as claimed in claim 3, further comprising a timing controller providing a horizontal sync signal and a polarity bit.

7. The image display system as claimed in claim 6, wherein the source driver further comprises a control circuit generating a modified horizontal sync signal based on the horizontal sync signal from the timing controller, to control the first and second switching circuits with the polarity bit from the timing controller.

8. The image display system as claimed in claim 6, wherein the source driver further comprises a control circuit generating a modified polarity bit based on the polarity bit from the timing controller, to control the first and second switching circuits accordingly.

9. The image display system as claimed in claim 6, further comprising a control circuit coupled between the timing controller and the source driver, wherein the control circuit generates a modified horizontal sync signal based on the horizontal sync signal from the timing controller, to control the first and second switching circuits of the source driver with the polarity bit from the timing controller.

10. The image display system as claimed in claim 6, further comprising a control circuit coupled between the timing controller and the source driver, wherein the control circuit generates a modified polarity bit based on the polarity bit from the timing controller, to control the first and second switching circuits accordingly.

11. The image display system as claimed in claim 1, wherein the first and second operational amplifiers are rail-to-rail operational amplifiers.

12. A method of driving a pixel array to display an image, comprising:

providing a first digital-to-analog converter, converting an N-bit digital code to a first analog signal, where N is a positive integer;

providing a second digital-to-analog converter, converting a K-bit digital code to a second analog signal, where K is a positive integer and is smaller than N;

during a first time period of scanning of a first row of the pixel array, coupling N bits of a first display data to the first digital-to-analog converter, coupling the K most significant bits of a second display data to the second digital-to-analog converter, wherein the first display data and the second display data are both N bits, connecting the first analog signal to a first operational amplifier that is coupled to a first data line of the pixel array, and connecting the second analog signal to a second operational amplifier that is coupled to a second data line of the pixel array; and during a second time period of the scanning of the first row of the pixel array and after the first time period, coupling the N bits of the second display data to the first digital-to-analog converter and connecting the first analog signal to the second operational amplifier.

13. The method as claimed in claim 12, further comprising:

providing a third digital-to-analog converter, converting an N-bit digital code to a third analog signal; and providing a fourth digital-to-analog converter, converting a K-bit digital code to an fourth analog signal, wherein:

the first and second digital-to-analog converters limit the first and second analog signals to within a first voltage range for positive polarity display; and the third and fourth digital-to-analog converters limit the third and fourth analog signals to within a second voltage range for negative polarity display.

14. The method as claimed in claim 13, further comprising:

during a third time period of scanning of a second row of the pixel array, coupling the N bits of the first display data to the third digital-to-analog converter, coupling the K most significant bits of the second display data to the fourth digital-to-analog converter, connecting the third analog signal to the first operational amplifier, and connecting the fourth analog signal to the second operational amplifier; and during a fourth time period of the scanning of the second row of the pixel array and after the third time period, coupling the N bits of the second display data to the third digital-to-analog converter and connecting the third analog signal to the second operational amplifier.

* * * * *